US008303103B2

(12) United States Patent
LeFevre et al.

(10) Patent No.: US 8,303,103 B2
(45) Date of Patent: Nov. 6, 2012

(54) PEAK POSITION DRUM MAINTENANCE UNIT FOR A PRINTING DEVICE

(75) Inventors: Jason Matthew LeFevre, Penfield, NY (US); Paul John McConville, Webster, NY (US); Michael Jon Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 300 days.

(21) Appl. No.: 12/789,637

(22) Filed: May 28, 2010

(65) Prior Publication Data

US 2011/0292142 A1 Dec. 1, 2011

(51) Int. Cl.
*B41J 2/01* (2006.01)

(52) U.S. Cl. ..... 347/103; 347/88; 347/89

(58) Field of Classification Search ..... 347/103, 347/88, 89

See application file for complete search history.

(56) References Cited

U.S. PATENT DOCUMENTS

| | | | | |
|---|---|---|---|---|
| 4,656,577 | A * | 4/1987 | Herman | 700/57 |
| 5,835,833 | A * | 11/1998 | Dalal et al. | 399/325 |
| 6,579,813 | B1 | 6/2003 | Kimura et al. | |
| 7,540,600 | B2 | 6/2009 | Fioravanti et al. | |
| 2005/0134632 | A1 | 6/2005 | Rousseau | |
| 2009/0009573 | A1 | 1/2009 | Larson et al. | |

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

An imaging device includes a substantially continuous web of media, and a web transport system configured to transport the continuous web along a web path. A print station is positioned along the web path and is configured to apply ink to the continuous web. A temperature leveling ink spreader is disposed along the web path downstream from the print station. The temperature leveling ink spreader includes a leveler roller including a heater configured to generate thermal energy to heat the leveler roller to a spreading temperature. The leveler roller is positioned to be partially wrapped by the continuous web to generate a predetermined dwell time between the continuous web and the leveler roller as the continuous web is being transported to equalize the temperatures of the web and ink on the web to within a predetermined range about the spreading temperature.

20 Claims, 3 Drawing Sheets

PEAK POSITION DRUM MAINTENANCE UNIT FOR A PRINTING DEVICE

TECHNICAL FIELD

The present disclosure relates to imaging devices, and in particular, to drum maintenance systems for use with such imaging devices.

BACKGROUND

Ink jet printers typically include one or more printheads having ink jets that eject drops of ink to form images on print media. The print media may comprise paper, transparency, and the like, and may be provided as a substantially continuous web of media or as discrete sheets of media. A number of different types of ink are available for use by the printheads of ink jet printers. For example, some ink jet printers are configured to utilize phase change ink for printing. Phase change inks are substantially solid at ambient temperatures, but transition to liquid ink when heated to a suitable melting temperature for the ink. Images may be formed on print media with melted phase change ink using a direct printing process or an indirect printing process. In a direct printing process, the melted phase change ink drops are ejected directly onto the print media. In an indirect print process, the melted phase change ink drops are ejected onto an intermediate imaging member for subsequent transfer to the print media.

In both the direct and indirect printing processes, the drops of melted phase change ink may be fixed to the print media by the application of pressure and/or heat to the ink on the print media. For example, in the indirect printing process, the intermediate imaging member may comprise a rotating drum upon which the drops of ink are deposited for forming the images on the print media. A second roller, also referred to as a transfer or transfix roller, is arranged adjacent to the imaging drum to form a nip through which the print media is fed in timed registration with the ink drops on the imaging drum. As the print media is being fed through the nip, the drops of ink are transferred from the imaging drum to the print media, and the pressure, and in some cases heat, generated in the nip between the imaging drum and the transfix roller spreads the drops out and fixes them to the print media.

In a direct printing process, the printheads of the printer are arranged to deposit ink directly onto the print media. The print media is then guided to a spreading assembly, or spreader, for fixing the ink to the print media. The spreader comprises a pair of rollers with one of the rollers in the pair comprising an image side roller, also referred to as a spreader drum, which contacts the printed side of the print media. The other roller in the pair is arranged adjacent to the spreader drum to form a nip through which the print media is fed. Similar to the direct printing process, as the print media is fed through the nip, the pressure, and in some cases heat, generated in the nip spreads the drops out and fixes them to the print media.

One difficulty faced in fixing ink to print media in both direct and indirect print processes is ink adhering or offsetting to the image side roller as the media is fed through the nip. To prevent ink from adhering or offsetting to the image side drum, a drum maintenance system applies release agent to the surface of the image side roller. The release agent is typically a silicone oil or similar fluid material configured to prevent ink from adhering to the surface of the image side drum. The maintenance system includes a release agent applicator, such as a foam roller, that applies the release agent to the drum surface, and a metering blade that meters the applied release agent to a desired thickness.

The metering blade of the drum maintenance system may also be configured to divert excess release agent from the drum surface to a collection pan, tub, or similar type of structure, so that the diverted release agent may be transported back to the applicator for reuse. To enable the release agent to be diverted from the drum surface by the metering blade, the metering blade in previously known systems are arranged below the drum so that excess release agent, debris, and/or contaminants diverted from the drum by the metering blade may flow down the metering blade body and/or drop into the collection pan. Previously known drum maintenance systems, however, are not capable of diverting and capturing release agent applied to the surface of the drum if there is not space available at the bottom of the drum for the placement of a metering blade.

SUMMARY

A drum maintenance system has been developed that enables a metering blade (and applicator) to be positioned at an upper, or peak location, with respect to the surface of an imaging drum or spreader drum while retaining the ability to divert excess release agent, debris, and/or contaminants from the drum surface to a collection pan. In one embodiment, a peak position drum maintenance system for use with an imaging device comprises a drum configured for rotation about an axis in a printer. The drum has an axial length that is greater than a width of print media used in the printer. The axial length of the drum defines a first collection region at a first end of the drum, a second collection region at a second end of the drum, and a media contact surface between the first and the second collection regions. An applicator is configured to apply release agent to the media contact surface as the drum rotates, and a metering blade is configured to meter the release agent applied to the drum to a predetermined thickness. The metering blade is arranged at a peak position with respect to a circumference of the drum extending from the first to the second collection region. A collection reservoir is positioned below the first and the second collection regions for receiving release agent from the first and the second collection regions.

In another embodiment, an imaging device comprises a print media transport system for transporting print media along a media path in a printer. An image side drum and a second roller are arranged to form a nip through which the print media is guided by the media transport system. The image side drum has an axial length that is greater than a width of the print media. The axial length of the drum defines a first collection region at a first end of the drum, a second collection region at a second end of the drum, and a media contact surface between the first and the second collection regions. A printhead system is configured to deposit ink onto one of the print media and the image side drum prior to the media being guided through the nip. An applicator is configured to apply release agent to the media contact surface as the drum rotates, and a metering blade is configured to meter the release agent applied to the drum to a predetermined thickness. The metering blade is arranged at a peak position with respect to a circumference of the drum extending from the first to the second collection region. A collection reservoir is positioned below the first and the second collection regions for receiving release agent from the first and the second collection regions.

In another embodiment, a method of operating a drum maintenance system comprises applying release agent to a media contact surface of an image side drum using an applicator; metering the release agent applied to the media contact surface to a predetermined thickness using the metering blade; diverting excess release agent axially along the media contact surface to collection regions at opposing ends of the media contact surface of the drum using the metering blade; and receiving diverted release agent from the collection regions using at least one collection reservoir positioned underneath the drum below the collection regions.

DETAILED DESCRIPTION

Figure 1:
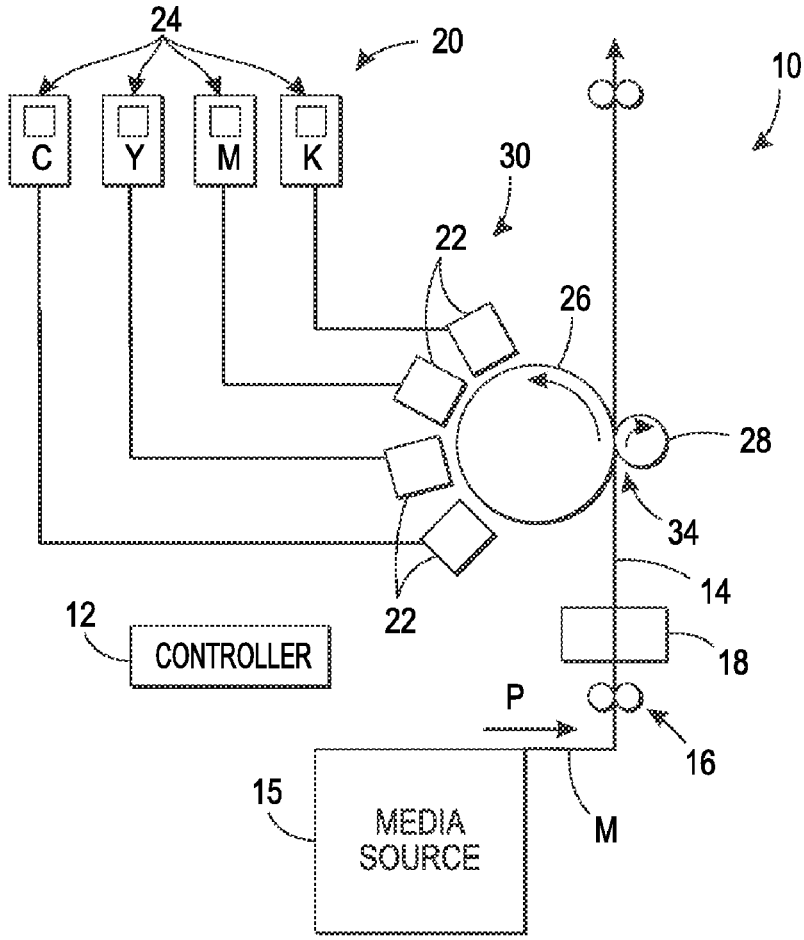
FIG. 1 is a simplified schematic view of an imaging device having an indirect printing system.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or continuous web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

Turning now to the drawings, FIG. 1 depicts a simplified schematic diagram of an imaging device 10. Operation and control of the various subsystems, components and functions of the imaging device 10 are performed with the aid of a controller 12. The controller 12 may be a self-contained, dedicated computer system having a central processor unit (CPU), electronic storage or memory, and a display or user interface (UI) (not shown). The controller 12 receives and manages image data flow between image input sources (not shown), which may be a scanning system or a work station connection, and the printheads 22. The controller 12 generates control signals that are delivered to the components and subsystems. These control signals, for example, include drive signals for actuating inkjets of the printheads 22 to eject drops to form images on print media.

The imaging device 10 includes a media transport system that is configured to transport print media 14 in a process direction P from a media source 15 along a media path M past various systems and devices of the imaging device 10, such as the printhead system 30. The media 14 may comprise any suitable type of media, such as paper, transparency, and the like, and may comprise individual sheets of print media, also referred to as cut sheet media, or a very long, i.e., substantially continuous, web of media, also referred to as a media web. When cut sheet media is used, the media source 15 may comprise one or more media trays as are known in the art for supplying various types and sizes of cut sheet media. When the print media 14 comprises a media web, the media source may be a spool or roll of media. In either case, the media transport system includes suitable devices, such as rollers 16, as well as baffles, deflectors, and the like (not shown), for transporting the media 14 along media path M in the imaging device 10.

Various media conditioning devices and systems may be positioned along the media path M of the imaging device for controlling and regulating the temperature of the print media 14 as well as the ink deposited thereon. For example, in the embodiment of FIG. 1, a preheating system 18 may be provided along the media path for bringing the print media to an initial predetermined temperature prior to reaching the printhead system 30. The preheating system 18 can rely on contact, radiant, conductive, or convective heat to bring the media to a target preheat temperature, which in one practical embodiment, is in a range of about 30° C. to about 70° C.

As depicted in FIG. 1, the media transport system is configured to transport the print media 14 past a printhead system 30 that includes at least one printhead 22 having ink jets for ejecting drops of ink to form images on the print media. One or more printheads may be provided for each color of ink used in the device 10. In the embodiment of FIG. 1, the imaging device 10 is configured to use four colors of ink, e.g., cyan, magenta, yellow, and black (CYMK), although more or fewer colors or shades, including colors other than CYMK, may be used. For simplicity, a single printhead is shown for each of the four primary colors—CYMK. Any suitable number of printheads for each color of ink, however, may be employed.

The imaging device 10 includes an ink supply system 20 that is configured to supply ink from at least one remote source 24 of ink to the printhead system 30. The imaging device 10 includes four (4) remote sources 24 of ink representing the four colors—CYMK. Any suitable number of remote ink sources may be used. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink supply system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, the imaging device may be configured to use any suitable marking material or ink including, for example, aqueous ink, oil-based ink, UV curable ink, or the like.

In the embodiment of FIG. 1, the printhead system 30 is configured to use an indirect marking process in which the printheads 22 are arranged to deposit ink onto an intermediate imaging member 26, referred to as an imaging drum. A second roller 28, also referred to as a transfer or transfix roller, is loaded against the surface of drum 26 to form a nip 34 through which the media 14 is fed in timed registration with the ink images deposited thereon by the printheads. Pressure, and in some cases heat, in the nip 34 causes the ink to be transferred from the drum 26 and fixed to the media 14.

Figure 2:
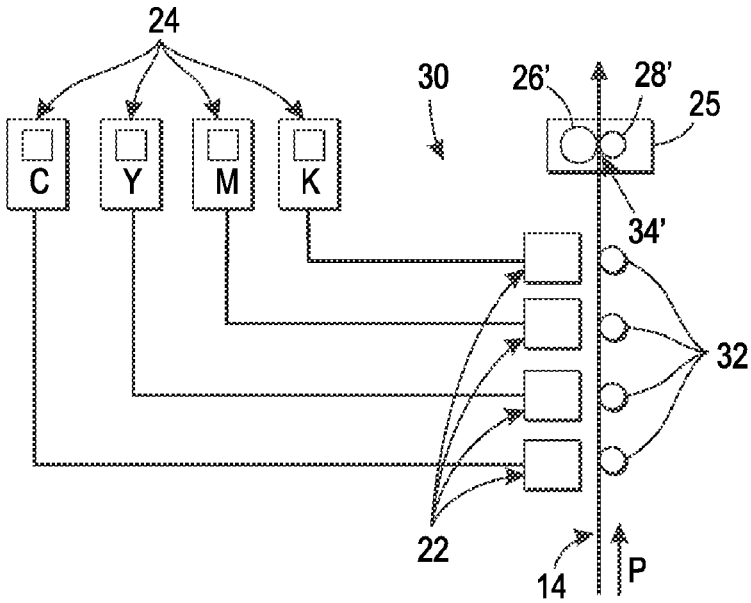
FIG. 2 depicts a direct printing system that may be utilized in the imaging device of FIG. 1 as an alternative to the indirect printing system.

In alternative embodiments, the printhead system 30 may be configured to utilize a direct marking process as shown in FIG. 2. In a direct marking process, the printheads of the printhead system 30 are arranged to deposit ink directly onto the media 14. The printed media is then guided to a spreading assembly 25 that includes an image side drum 26' and a second roller 28', also referred to as a pressure roller, that are arranged to form a nip 34' through which the media is fed. Similar to nip 34 of FIG. 1, the nip 34' is configured to apply pressure, and in some cases heat, to the ink in order to fix the ink to the media 14. The nip 34' is also configured to spread out the drops of ink on the media so that spaces between adjacent drops are filled and image solids become uniform.

In both the direct and indirect printing process, release agent is applied to the surface of the roller, or drum, which contacts ink in the nip to prevent ink from adhering or offsetting to the image side roller of the nip. For example, in the embodiment of FIG. 1, release agent is applied to the imaging drum 26, and, in the embodiment of FIG. 2, release agent is applied to the drum 26'. For the purposes of this disclosure, the term "image side drum 26" or "image side roller 26" shall be used to refer to both the imaging drum 26 of the FIG. 1 and the image side drum 26' of FIG. 2, and the nip 34 shall be used to refer to both the nip 34 of FIG. 1 and the nip 34' of FIG. 2. In general, the terms "image side drum" and "image side roller" refer to the roller, or drum, that contacts unfixed ink as the media is fed through the nip 34, 34'. The term "nip" is defined as the contact region between the image side drum, the second roller, print media, and ink.

Figure 3:
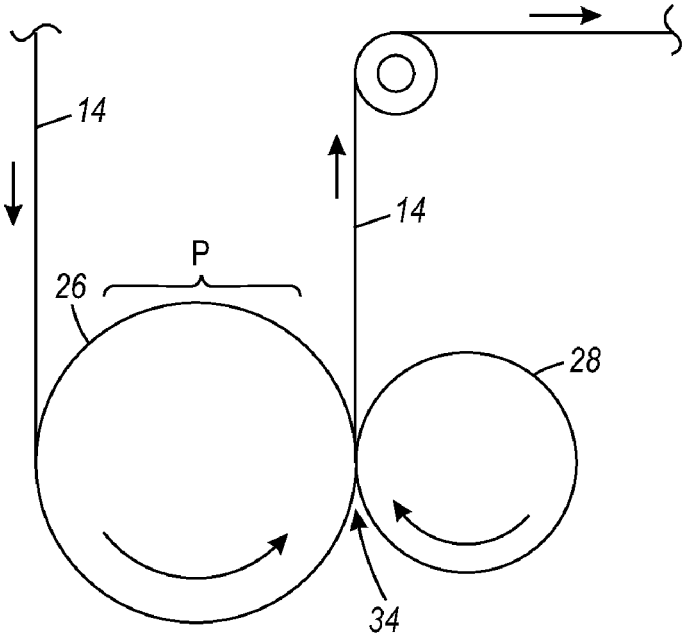
FIG. 3 (Prior Art)
FIG. 3 depicts a spreading assembly of a continuous web printer showing the available locations for a drum maintenance system.

As mentioned, previously known drum maintenance systems are required to be positioned with the metering blade at or near the bottom of the image side roller to allow gravity to facilitate transport of excess release agent from the surface of the drum to a collection reservoir. In some cases, however, the area at or near the bottom of the image side drum 26 may not be available for the placement of a metering blade or other components of the drum maintenance system. For example, some phase change ink printers are configured to bring ink and media temperatures to a uniform target temperature or within a target temperature range prior to the ink and media entering the nip 34. A method that may be used to substantially equalize ink and web temperatures in a continuous web printer involves wrapping the media web 14 partially around the image side drum 26 prior to the media 14 reaching and being fed through the nip 34, as depicted in FIG. 3. In the system of FIG. 3, the image side drum 26 is heated to a predetermined operating temperature that enables conductive heat transference to occur between the media 14 (and any ink thereon) and the image side drum 26 to bring the temperatures of the web and ink toward the operating temperature of the image side drum 26.

The areas around the circumference of the drum 26 that are available for the placement of a drum maintenance system are limited to the areas that are not wrapped, or covered, by the media 14. In some cases, the configuration of a printer may require that the media 14 be wrapped around a lower or bottom portion of the image side drum 26 as depicted in FIG. 3 leaving only the upper portion P of the drum 26 available for the positioning of a drum maintenance system. Previously known drum maintenance systems, however, are not capable of adequately controlling the release agent applied to the surface of the drum if the metering blade is located at an upper, or peak, location P around the circumference of the drum. As used herein, the term "peak" refers to positions around the circumference of the image side drum 26 that are at or near the uppermost portion of the circumference of the drum in the vertical direction.

Figure 4:
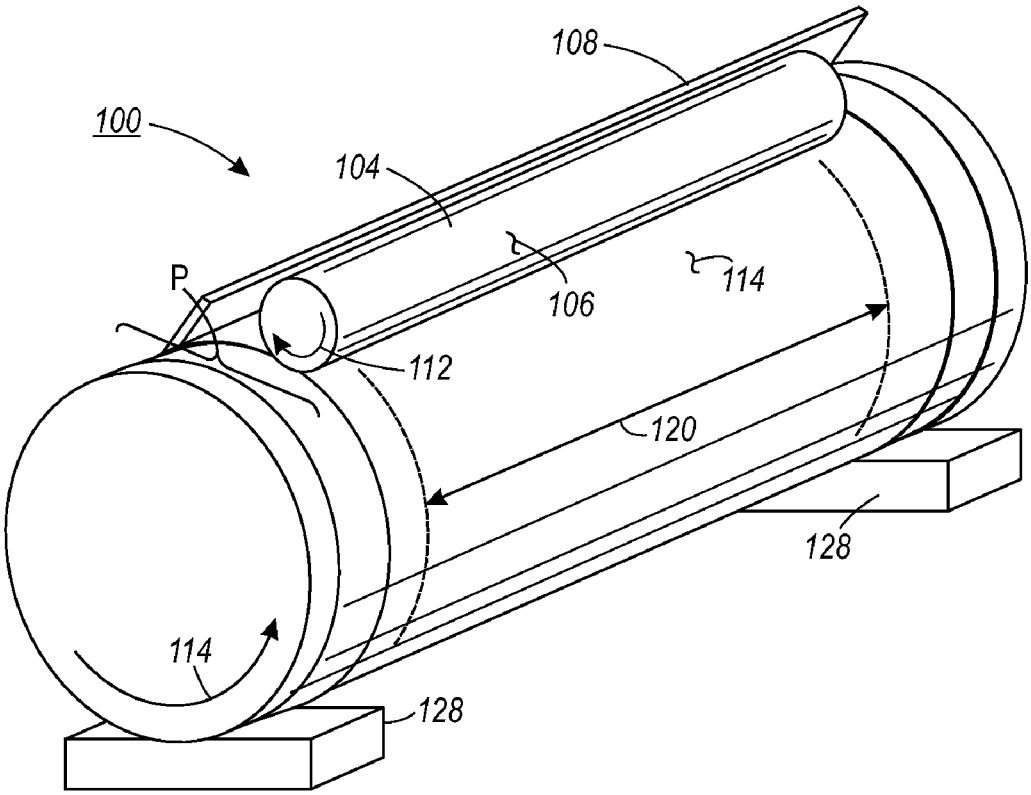
FIG. 4 is a perspective view of an embodiment of a peak position drum maintenance system that may be used with the spreading assembly of FIG. 3.

As an alternative to previously known drum maintenance systems that are limited to a bottom or lower positioning with respect to the image side drum, the present disclosure is directed to a drum maintenance system that enables the drum maintenance system, and in particular, the metering blade of the drum maintenance system to be arranged at a peak position P with respect to circumference of the image side drum 26. An embodiment of a peak position drum maintenance system 100 is illustrated in FIG. 4. As depicted, the peak position drum maintenance system 100 includes an applicator 104 for distributing release agent to the surface of the image side drum 26, and a metering blade 108 for metering the release agent applied to the surface of the drum 26 to a desired thickness. As depicted, each of the applicator 104 and the metering blade 108 are arranged at or near the peak P of the image side drum 26. Any suitable type of applicator 104 may be used to apply release agent to the drum surface.

In one embodiment, the applicator 104 comprises a roller including an absorbent material, such as extruded, salt-leached, polyurethane foam, although any suitable material may be used. The absorbent material is saturated with release agent to serve as a release agent delivery layer 106 for the applicator 104. Release agent may be provided to the delivery layer 106 of the roller 104 in any suitable manner. In one embodiment, the delivery layer surrounds a hollow, cylindrical tube (not shown) that contains a quantity of release agent. The tube includes openings, such as perforations, that allow the release agent to escape the tube to saturate the delivery layer. The tube may comprise, for example, a plastic, blow-molded bottle, or similar type of container, although any suitable material and/or construction for the tube may be used.

The foam delivery layer 106 of the applicator 104 is positioned in contact with the surface 114 of the image side drum so that, as the image side drum rotates in direction 110, the applicator 104 is driven to rotate in the opposite direction 112 of the drum by frictional contact with the drum surface 114. The point of contact between the delivery layer and the drum surface 114 continuously moves so that a fresh area of the delivery layer 106 is continuously contacting the drum surface 114 to apply the release agent thereto. The metering blade 108 is positioned to meter the release agent applied to the drum surface 114 to a desired thickness. The metering blade 108 may be formed of an elastomeric material such as urethane supported on an elongated metal support bracket (not shown) although any suitable configuration for the metering blade may be used. The applicator 104 and the metering blade 108 may be operably supported adjacent to the drum surface 114 in any suitable manner. In embodiments, the applicator 104 and the metering blade 108 may be provided in a housing or frame 113 (FIG. 6) that enables at least the applicator 104 and the metering blade 108 of the peak position drum maintenance system 100 to installed and removed from the printer as a single unit.

In operation, the release agent deposited onto the drum surface 114 by the applicator 104 builds up in front of the metering blade 108 to form what may be referred to as an "oil bar." The tip of the metering blade 108 is suitably positioned with respect to the drum surface 114 to spread the "oil bar" of release agent onto the drum surface 114 so that a layer of release agent having a substantially uniform thickness covers at least the area of the drum surface that contacts the media. In previously known drum maintenance systems, the metering blade was positioned at a lower portion of the drum above a catch pan or tub so that excess release agent from the oil bar diverted from the drum surface by the blade 108 may run down the blade 108 and/or drip into the catch pan. The metering blade 108 (and the applicator) in the peak position drum maintenance system, however, is positioned at an upper portion of the drum with the main body of the metering blade being substantially above the oil bar. Consequently, excess release agent from the oil bar cannot be diverted down the body of the metering blade to a catch pan or similar structure when the metering blade is at a peak position of the drum.

Figure 5:
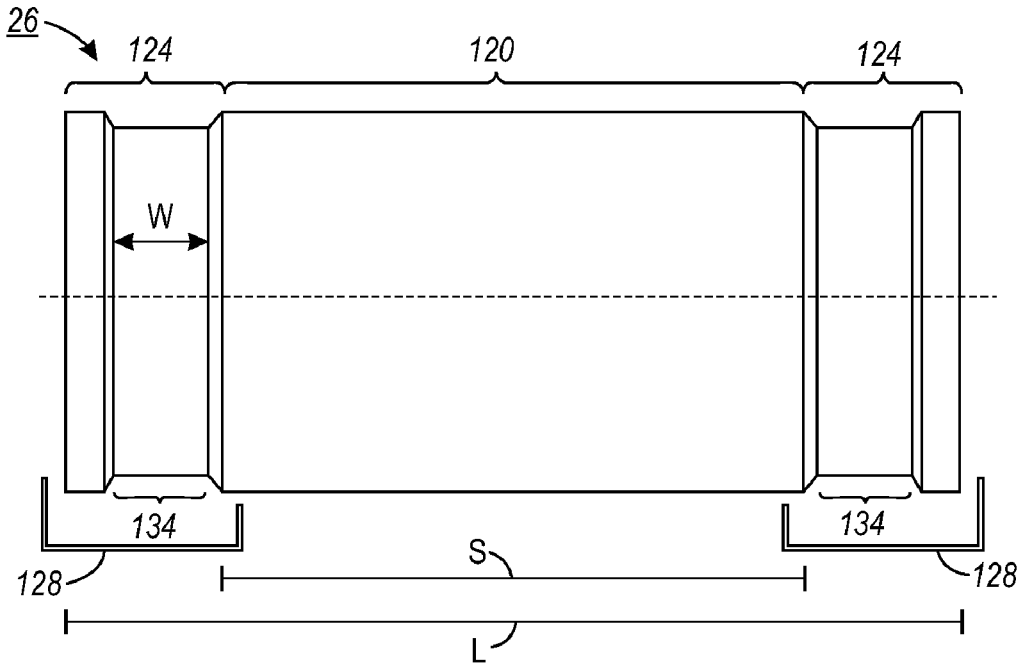
FIG. 5 is an elevational view of the image side drum of the peak position drum maintenance system of FIG. 4.

To enable excess release agent, as well as paper debris and other contaminants, to be diverted from the drum surface 114 when the metering blade 108 is located at a peak position of the drum, as shown in FIG. 4, the image side drum 26 is provided having an axial length L (FIG. 5) that is greater than the width of the print media with which it is used. The greater axial length L of the drum 26 enables a portion of the axial length L of the drum (corresponding to the width of the media) to be used for contacting the media in the nip 34 (FIGS. 1 and 2). Because the length L of the drum 26 is greater than the width of the media, the portions of the drum that extend beyond the width of the media may be used as release agent control surfaces for the peak position drum maintenance system 100 without interfering or contaminating the media area of the drum 26. As best seen in FIG. 5, the image side drum 26 for use with the peak position drum maintenance system 100 has an axial length L that defines a media contact surface, or area, 120 in a central or intermediate portion of axial length L of the drum 26. As used herein, terms such as "surface," "area," and "region" used in reference to a rotating cylindrical member, such as image side drum 26, refers to a cylindrical portion of the drum between two points along the axial length of the drum. For example, a surface or area of the axial length of the drum may be thought of as the cylindrical portion of the drum located between two spaced apart parallel planes arranged perpendicular to the axis of rotation of the drum.

The media contact surface 120 has a length S that is at least as wide as the print media of the printer. In use, the drum 26 is suitably arranged in the printer so that the media contact surface 120 of the drum 26 is arranged in the path of the media 14 in the printer. The portions 124 of the axial length L of the drum 26 that extend beyond the media contact surface 120 at each end of the drum 26 do not contact media during operation which allows these areas 124 to serve as release agent collection regions, or surfaces, 124 for the peak position drum maintenance system 100. The drum 26 may extend beyond the width of the media contact surface 120 any suitable distance at each end to provide the release agent collection surfaces 124. The applicator 104 and the metering blade 108 each have a longitudinal dimension that enables the applicator 104 and metering blade 108 to extend across the media contact surface 120 of the drum 26. The lengths of the applicator 104 and metering blade 108 enable the applicator 104 and the metering blade 108 to deposit and meter, respectively, release agent across the entire media contact surface 120 of the drum.

Figure 6:
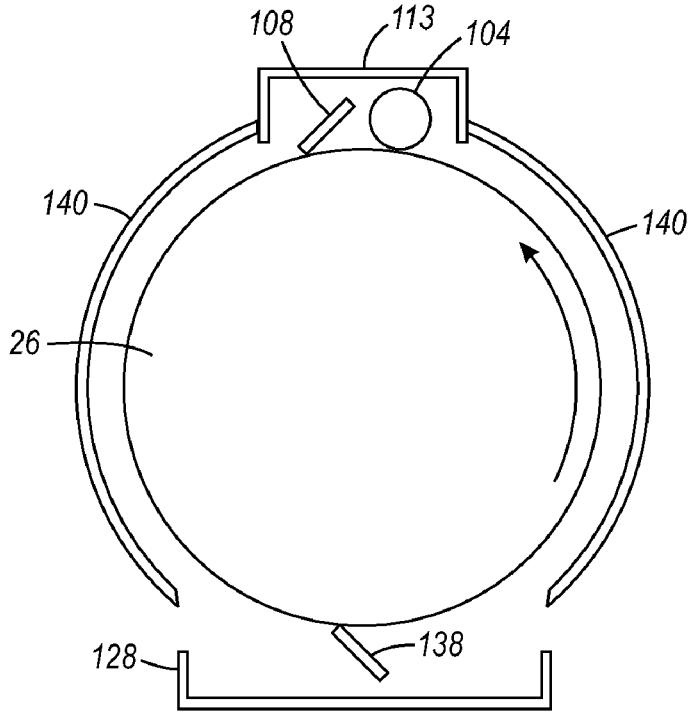
FIG. 6 is a side elevational view of another embodiment of a peak position drum maintenance system.

The ends of the metering blade 108 extend to or slightly into the release agent collection regions 124. In operation, as the metering blade 108 meters a layer of release agent onto the media contact surface 120, excess release agent builds up in front of the blade 108 and begins to be moved or pushed axially along the media contact surface 120 of the drum in front of the metering blade 108 until the excess release agent passes beyond the ends of the blade into the release agent collection regions 124 at either side of the media contact surface 120. A collection reservoir 128 is positioned underneath the image side drum 26 substantially below the collection region 124 at each end of the drum 26. Once the excess release agent and any debris or contaminants therein is diverted to the collection surfaces, gravity draws the diverted release down to the bottom of the drum 26 where it may then fall into the collection reservoirs 128 positioned below the drum 26. A collection reservoir 128 may comprise any suitable type of structure, such as a tub or trough, which is capable of catching, or otherwise receiving, the release agent that drops from the drum surface. In the embodiment of FIGS. 4 and 5, a separate collection reservoir 128 is positioned under each end of the drum below the collection regions 124. In alternative embodiments, a single reservoir that extends the full length of the drum may be used. In addition, in some embodiments, as depicted in FIG. 6, cleaning blades 138, or similar types of devices, may be positioned at the bottom of the drum 26 in the collection regions to wipe or scrape the diverted release agent, and any debris, from the drum surface. Cleaning blades 138 may be positioned above the collection reservoirs 128 so that release agent and debris may be guided down the cleaning blade 138 into the reservoir 128.

In some embodiments, the collection regions 124 of the drum may be provided with surface features that facilitate the flow of the diverted release agent toward the bottom of the drum in the collection region while substantially preventing the diverted release agent from travelling back into the media contact surface 120 of the drum. For example, in the embodiment of FIGS. 4 and 5, the collection regions 124 are provided with annular grooves, or troughs, 134 that may be used to at least partially trap or confine the diverted release agent to the collection regions 124 as well as guide the release agent to a suitable position above the collection reservoirs 128. As used herein, the terms "annular groove" and "annular trough" refer to a continuous recess or indentation in the surface of the drum having a width dimension W that follows the axis A of the drum and a depth dimension D that extends toward the axis of rotation the drum. The width W and depth D dimensions of the grooves, or troughs, may have any suitable magnitude that facilitates the movement of the release agent to the lower portion of the drum and prevents the release agent from moving toward the media contact surface 120. A single groove 134 is shown in the collection regions 124 at each end of the drum. In alternative embodiments, more than one groove 134 may be provided in each collection region 134.

In another embodiment, to prevent the release agent that has been diverted to the collection surfaces 124 from being ejected from the surface of the drum due to centrifugal force as the drum rotates, shield structures 140 may be provided in the collection regions 124 that follow the curvature of the drum surface as depicted in FIG. 6. Although not visible in FIG. 6, a separate shield 140 may be provided at each end of the drum 26 that surrounds the corresponding collection region 124. Each shield 140 is open at the bottom above the collection reservoirs 128 to enable release agent to drop into the reservoirs. In embodiments, the shields 140 may be provided separately from the collection reservoirs or provided as integral parts of the collection reservoirs. The shield may comprise a single component or be made up of multiple assembled components. In addition, shields may be formed of any suitable material, such as plastic or metal, and may have any suitable arrangement with respect to the drum surface that enables the shields to prevent release agent and debris from being ejected from the drum surface in the collection surfaces and contaminate other printer components.

One issue that may be faced in utilizing the peak position drum maintenance system described above is the management of the oil bars (and any debris or contaminants therein) in front of the metering blade when the printer is not being operated. Leftover oil bars may not be able to be adequately metered by the metering blade when the system is restarted. In addition, the oil bars may run down the drum surface and drip down onto printer components below the media contact surface of the drum. A number of suitable methods and/or devices may be used to remove or reduce the size of the oil bars during periods of inactivity of the printer. One method that may be used to mitigate the effects of oil bars during down times is to use an "air knife," as they are known in the art. An air knife (not shown) includes high velocity impinging air jets that may be used to distribute the oil bar over the drum surface so that there was no visible oil bar.

The collection reservoirs 128 of the peak position drum maintenance system 100 are capable of holding a limited amount of the diverted release agent. In one embodiment, the collection reservoirs are configured to be removed from the printer so that the reservoirs may be emptied and reinstalled in the printer. Alternatively, a recycling system (not shown) may be provided that is configured to filter the release agent collected in the reservoirs and to return the filtered release agent to the applicator for reuse.

The embodiments and features of the peak position drum maintenance described above enable release agent to be applied and metered to the drum surface at upper portions of the circumference of the image side drum while still providing for control and capture of release agent and/or debris diverted from the drum surface by the metering blade. It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A peak position drum maintenance system for use with an imaging device, the system comprising:

a drum configured for rotation about an axis in a printer, the drum having an axial length that is greater than a width of print media used in the printer, the axial length of the drum defining a first collection region at a first end of the drum, a second collection region at a second end of the drum, and a media contact surface between the first and the second collection regions;

an applicator configured to apply release agent to the media contact surface as the drum rotates;

a metering blade configured to meter the release agent applied to the drum to a predetermined thickness, the metering blade being arranged at a peak position with respect to a circumference of the drum and extending between the first and the second collection region;

a collection reservoir positioned below the first and the second collection regions for receiving release agent from the first and the second collection regions.

2. The system of claim 1, further comprising a second roller arranged adjacent to the drum to define a nip through which the print media is guided in the printer.

3. The system of claim 2, the media contact surface being positioned to contact ink on the print media as the print media is guided through the nip.

4. The system of claim 3, the ink comprising melted phase change ink.

5. The system of claim 1, the metering blade being configured to divert some of the release agent applied to the media contact surface of the image side drum to the first and the second collection regions.

6. The system of claim 5, the first and the second collection regions each including an annular groove for guiding diverted release agent to a lower portion of the drum above the collection reservoir.

7. The system of claim 1, further comprising a shield that surrounds the first and the second collection regions.

8. An imaging device comprising:

a print media transport system for transporting print media along a media path in a printer;

an image side drum and a second roller arranged to form a nip through which the print media is guided by the media transport system, the image side drum having an axial length that is greater than a width of the print media, the axial length of the drum defining a first collection region at a first end of the drum, a second collection region at a second end of the drum, and a media contact surface between the first and the second collection regions;

a printhead system configured to deposit ink onto one of the print media and the image side drum prior to the media being guided through the nip; and a peak position drum maintenance system including:

an applicator configured to apply release agent to the media contact surface as the drum rotates;

a metering blade configured to meter the release agent applied to the drum to a predetermined thickness, the metering blade being arranged at a peak position with respect to a circumference of the drum and extending between the first and the second collection region; and a collection reservoir positioned below the first and the second collection regions for receiving release agent from the first and the second collection regions.

9. The device of claim 8, the media contact surface being configured to contact the ink as the print media is guided through the nip.

10. The device of claim 9, the release agent being configured to prevent the ink from adhering to the media contact surface of the image side drum.

11. The device of claim 10, the ink comprising melted phase change ink.

12. The device of claim 8, the metering blade being configured to divert some of the release agent applied to the media contact surface of the image side drum to the collection regions.

13. The device of claim 12, the first and the second collection regions each including an annular groove for guiding diverted release agent to a lower portion of the image side drum.

14. The device of claim 8, the peak position drum maintenance system further comprising a shield that surrounds the first and the second collection regions.

15. A method of operating a drum maintenance system:

applying release agent to a media contact surface of an image side drum using an applicator;

metering the release agent applied to the media contact surface to a predetermined thickness using the metering blade;

diverting excess release agent axially along the media contact surface to collection regions at opposing ends of the media contact surface of the drum using the metering blade; and receiving diverted release agent from the collection regions using at least one collection reservoir positioned underneath the drum below the collection regions.

16. The method of claim 15, the image side drum being arranged adjacent to a second roller and defining a nip therebetween, the method further comprising:

guiding print media through the nip; and depositing ink onto one of the print media and the image side drum prior to the print media being fed through the nip.

17. The method of claim 16, the ink comprising melted phase change ink.

18. The method of claim 16, further comprising:

guiding release agent diverted to the collection surfaces from an upper location to a lower location on the circumference of the drum using annular grooves formed in each of the collection surfaces.

19. The method of claim 16, further comprising:

shielding the collection surfaces to prevent release agent from being ejected from the collection surfaces as the image side drum rotates using a shield.

20. The method of claim 16, further comprising:

pumping the release agent received in the collection reservoirs back to the applicator for reuse.

* * * * *